US007667168B2

(12) United States Patent
Smith

(10) Patent No.: US 7,667,168 B2
(45) Date of Patent: Feb. 23, 2010

(54) MULTI-LEVEL STACK-A-PLATE ARRANGEMENT

(76) Inventor: Christine Brown Smith, 13414 Chimney Sweep, Hou, TX (US) 77041

( * ) Notice: Subject to any disclaimer, the term of this patent is extended or adjusted under 35 U.S.C. 154(b) by 0 days.

(21) Appl. No.: 11/487,753

(22) Filed: Jul. 17, 2006

(65) Prior Publication Data

US 2007/0045303 A1 Mar. 1, 2007

(51) Int. Cl.
*H05B 6/80* (2006.01)

(52) U.S. Cl. ..... 219/732; 219/763; 126/338

(58) Field of Classification Search ..... 219/732, 219/730, 752, 754, 762, 763, 725; 126/337 A, 126/337 R, 338; 99/DIG. 14, 448
See application file for complete search history.

(56) References Cited

U.S. PATENT DOCUMENTS

| | | | | |
|---|---|---|---|---|
| 3,662,141 | A * | 5/1972 | Schauer, Jr. | 219/763 |
| 4,847,461 | A * | 7/1989 | Gilmore | 219/732 |
| 6,273,284 | B1 * | 8/2001 | Nottage | 220/4.26 |

FOREIGN PATENT DOCUMENTS

| | | | | |
|---|---|---|---|---|
| DE | 37 03 806 | A1 * | 8/1988 | |
| JP | 59-195034 | * | 11/1984 | 219/732 |
| JP | 1-204386 | * | 8/1989 | 219/730 |

* cited by examiner

*Primary Examiner*—Quang T Van
(74) *Attorney, Agent, or Firm*—Delphine James

(57) ABSTRACT

A stackable cooking vessel arrangement for microwave ovens wherein the arrangement comprises a plurality of plate members suspended at multiple tiers by leg support members within the cooking cavity of microwave ovens.

14 Claims, 5 Drawing Sheets

MULTI-LEVEL STACK-A-PLATE ARRANGEMENT

BACKGROUND

The present invention relate to the field of cookware. More specifically, the present invention relates to cookware designed for the microwave oven.

Microwave ovens provide rapid cooking of foods and are used in ninety-percent of American homes today. Traditional cooking vessels are not always suitable for microwave ovens. Some cooking vessels such as those made of metal cannot be utilized in microwave ovens. However, many microwave-cooking vessels are made of a specially designed plastic. The present invention is a unique stackable cooking vessel arrangement specifically designed for the microwave oven.

SUMMARY

It is the object of the present invention to provide an efficient cookware for the microwave oven. A stackable microwave cooking vessel arrangement forms the basis of the present invention. This arrangement further comprises a plurality of operatively associated plate support members. Each support member further comprises a plurality of openings for heat distribution within the cavity of the microwave oven.

DETAILED SPECIFICATIONS

Figure 1:
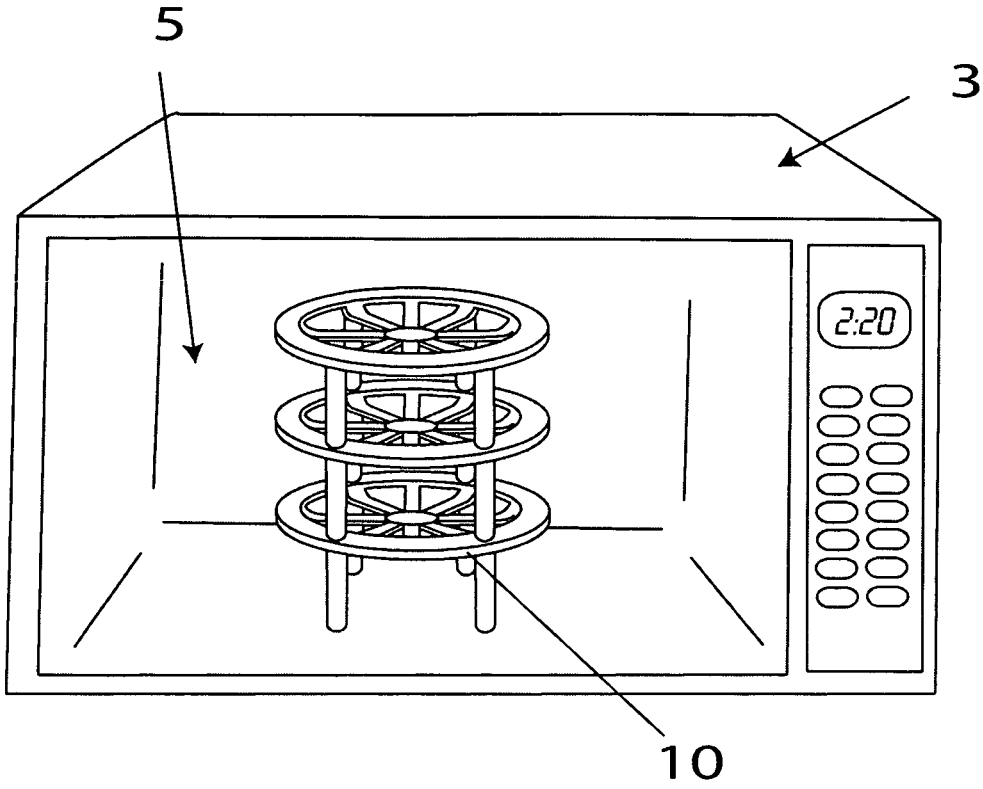
FIG. 1 is a perspective view of the stackable cooking vessel arrangement in the microwave oven.

As depicted in FIG. 1, the stackable cooking vessel arrangement forms the basis of the present invention reference generally by numeral (10). The cooking vessel is specifically designed for use within the cooking cavity (5) of a conventional microwave oven (3). Cooking vessel (10) is dimensioned to fit within medium or large size microwave ovens.

The cooking vessel arrangement (10) further comprises in general a plurality of plate support members (15) wherein each plate support member (15) is adapted to suspend at different heights within the cooking cavity of a conventional microwave oven. Each plate support member (15) is made of a plastic material that is suitable to be used within the microwave oven. This plastic material should be designed to warm food faster, but cool down once the door of the microwave oven is opened.

Figure 2:
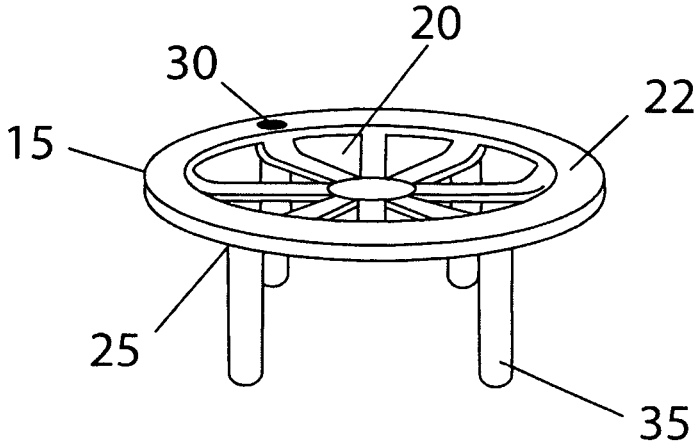
FIG. 2 is a side view of a single plate member.
Figure 3:
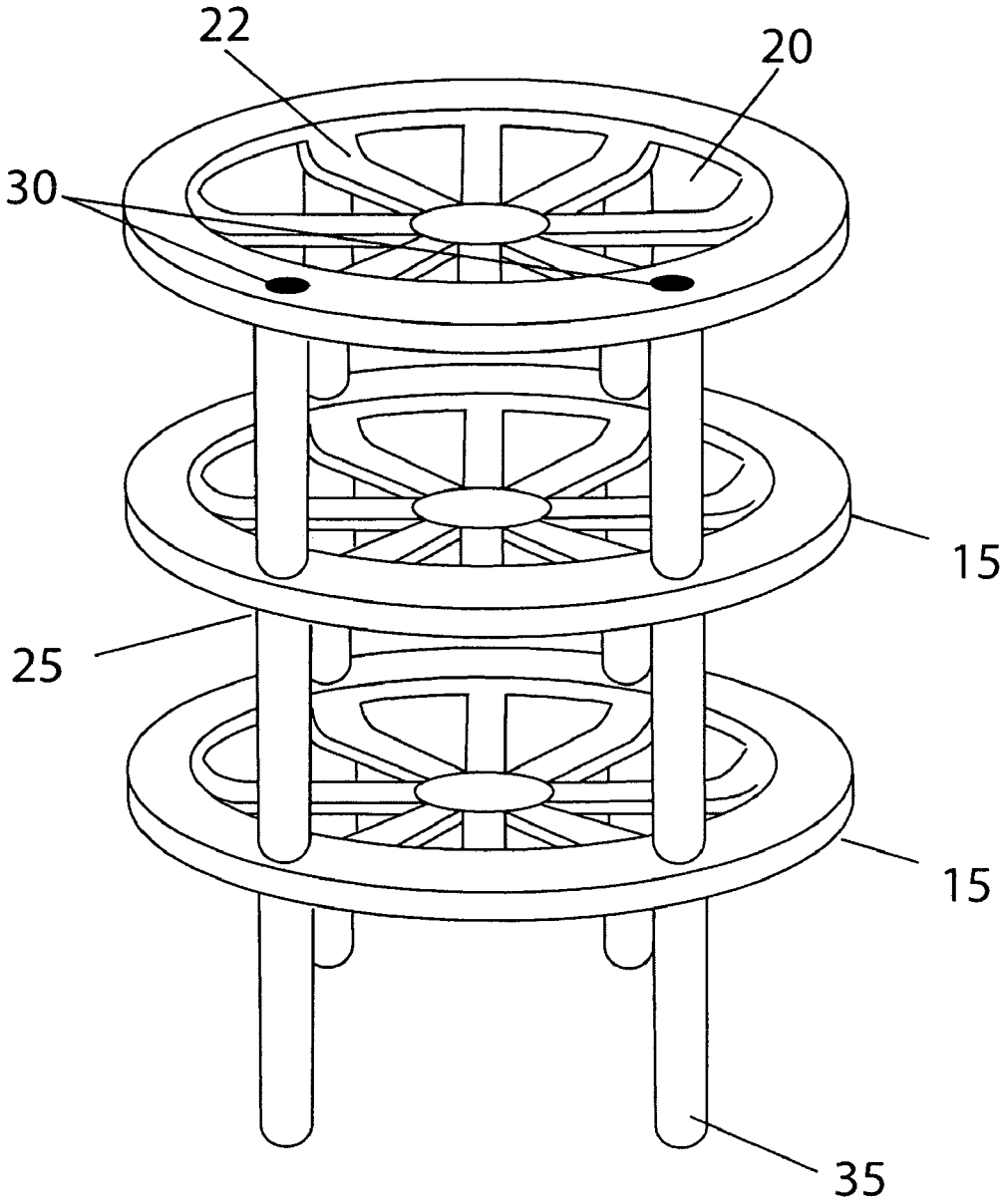
FIG. 3 is a side view of a multi-level stack plate arrangement.

Referring to FIG. 2, there is shown a top view of plate support member (15). Plate support member (15) is provided generally with a circular configuration. Plate support member (15) further comprises a plurality of openings (20) with a triangular configuration The plurality of openings (20) provides ventilation for the heat to circulate within the cooking cavity of the microwave oven. It can be appreciated that other geometric configurations can be substituted with the present invention such as oval rectangular, octagonal, and circular. Each opening in each plate support member (15) can have the same or different dimensions. As shown each opening (20) extends from the center of plate support member (15) to the peripheral edge of plate support member (15).

Plate support member (15) has a predetermined depth with a further defined by a top surface (22) and a bottom surface (25). In the preferred embodiment, top surface (22) of plate support member (15) is adapted with a plurality of evenly spaced recesses (30) disposed along the peripheral edge of the top surface of plate support member (15). Bottom surface (25) of plate support member (15) is adapted with a plurality of integrated leg members (35). Each leg member (35) projects outwardly and linearly downward therefrom. In the preferred embodiment, the number of recesses (30) corresponds to the number of leg support members (35). Additionally, in the preferred embodiment, four leg support members (35) project outwardly to support plate support member (35). The depth of the plate support member (15) can be at least 1 to 2 inches. However, the depth of plate support member (15) is not limited to that particular depth.

Plate support members (15) are adapted to operatively and releasably interconnect with one another. As shown in FIG. 1, each recess (30) is adapted to receive and engage with a corresponding leg support member (35). When outside of the microwave each plate member (15) can function as an independent food tray.

Figure 6:
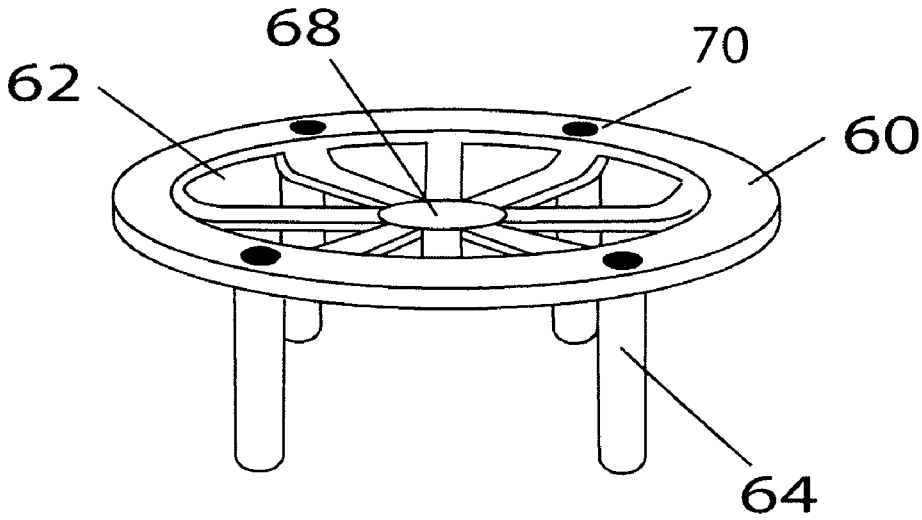
FIG. 6 is a side view of an alternative embodiment of the single plate member.
Figure 7:
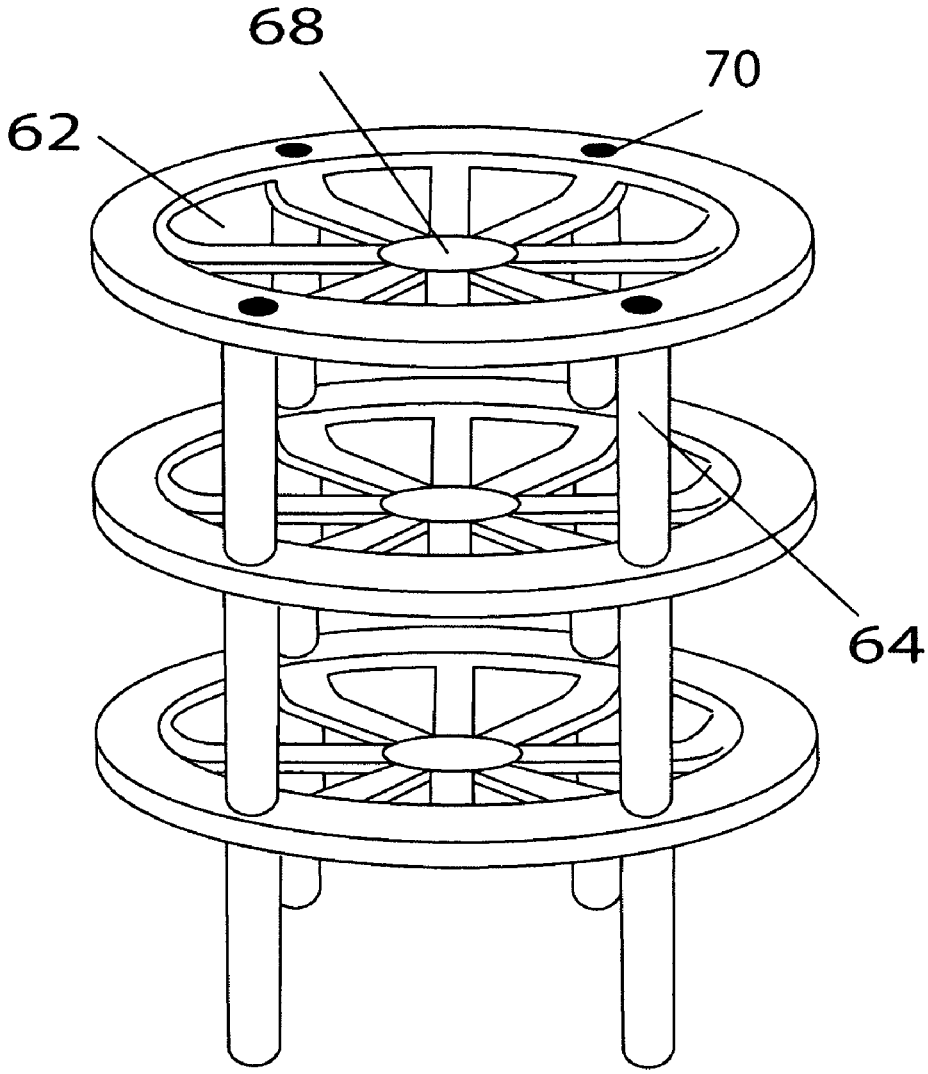
FIG. 7 is a perspective view of an alternative embodiment of the stackable cooking vessel arrangement.

Referring to FIGS. 6 and 7 there is shown another embodiment of plate support member (15). In this embodiment plate support member (15) further comprises a bowl frame 62 having a circular opened top edge. Collar 60 circumferentially surrounds the opened top edge and is integrally attached thereto. A plurality of slits 68 is positioned within bowl frame 62. Each slit extends from the center of the bowl to the top edge of the bowl and is permanently affixed thereto. Each slit can be triangular in shape or rectangular in shape or another suitable geometric configuration. In the preferred embodiment, bowl frame 62 is opened. However, bowl frame can be closed. The underside of collar 60 is adapted with a plurality of integrated leg members (64). Each leg member (64) projects outwardly and linearly downward therefrom.

Plate support members (15) are adapted to operatively and releasably interconnect with one another. As shown in 7, each recess (70) is adapted to receive and engage with a corresponding leg support member (64). When outside of the microwave each plate member (15) can function as an independent food tray.

Figure 5:
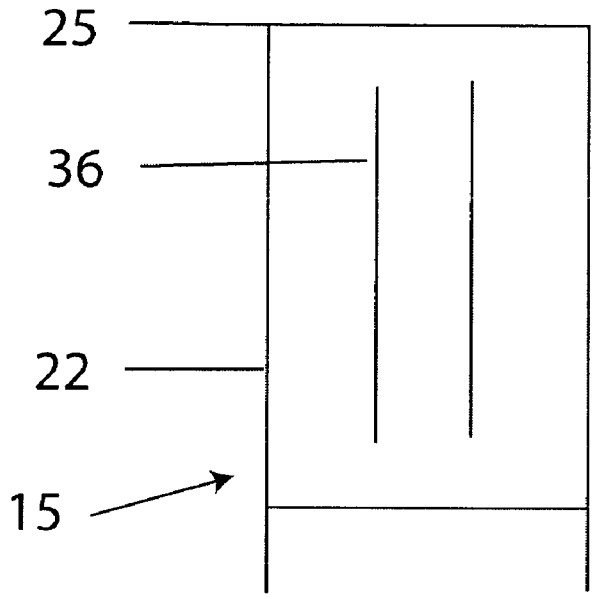
FIG. 5 is a cross-sectional of a single plate member.

Additionally, as shown in FIG. 5, one or more plate support members (15) can be adapted with an interior metal plate (36), which is completely sealed between the upper surface (22) and lower surface (25) of plate support member (15). Heating element (36) provides better heat distribution and simulates the cooking of a convention oven. Heating element (36) can be made of aluminum or another suitable material. In the alternative embodiment of plate member 15 shown in FIGS. 6 and 7 heating element can be incorporated within collar 60.

The present invention can be adapted with a cover (37), which encompasses one or more the plate support member (15). Cover 37 would be utilized to prevent splatter within the cavity of the microwave oven.

Figure 4:
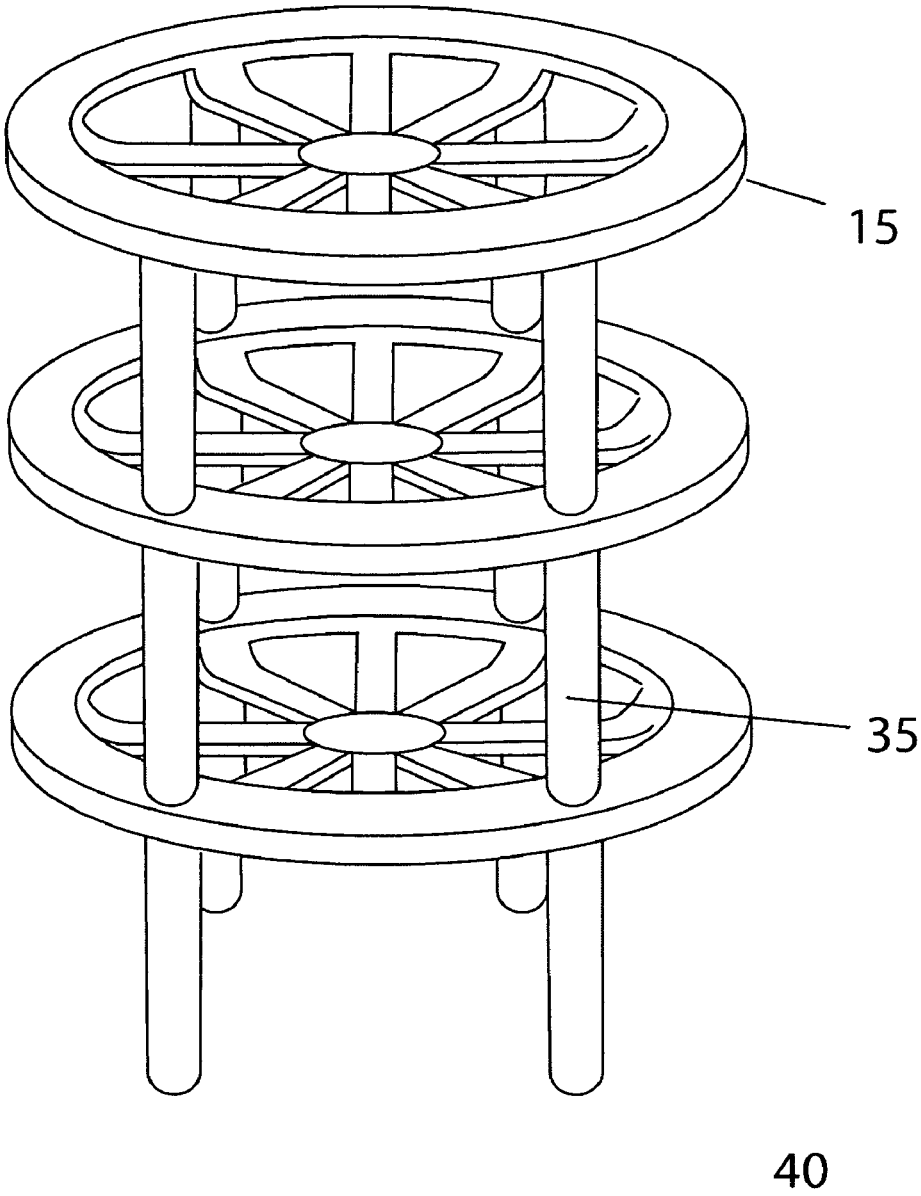
FIG. 4 is a side view of a multi-level stack plate arrangement on turntable.

In other embodiments, as shown in FIG. 4, cooking vessel (10) can be supported by pedestal turntable (40). As depicted, the central portion of bottom surface (25) of plate support member (15) is adapted to releasably engage with pedestal turntable (40). Pedestal turntable (40) has a built-in spinning mechanism that can be actuated by a switch. The turntable (40) is an accessory that can be used in microwave ovens that does not have a built in spinning mechanism.

What is claimed is:

1. A multi-level stackable cooking vessel for a microwave oven, the cooking vessel comprising:

a plurality of plate members dimensioned to fit inside a cooking cavity of the microwave oven;

each plate member having a predetermined depth, plate member further defined by a top side, under side, a center portion and an outer peripheral edge;

a plurality of openings strategically positioned within each plate member, each opening extending therethrough;

a plurality of integrated leg support members strategically positioned underneath each plate member, each leg member projecting linearly downward therefrom to short predetermined distance defining a lower end; and a plurality of recesses strategically situated on the top side of each plate member, the plurality of recesses corresponding to the plurality of leg support members, each recess adapted to operatively and releasably engage with the lower end of a corresponding leg member of a second plate member located thereabove wherein a multi-level stackable arrangement is formed.

2. The cooking vessel of claim 1 wherein at least one opening has a triangular shape.

3. The cooking vessel of claim 2 wherein the at least one opening extends from the center portion to the outer peripheral edge of each plate member.

4. The cooking vessel of claim 1 wherein each plate member has a circular configuration.

5. The cooking vessel of claim 1 wherein each plate member is supported by four integrated leg members.

6. The cooking vessel of claim 1 further comprising:

a heating element member sandwiched between the topside and the under side of each plate member; and the heating element member completely encompassed within the plate member.

7. The cooking vessel of claim 1 further comprising:

a turntable with a built-in spinning mechanism; and the turntable adapted to operatively and releasably engage underneath the center portion of each plate member wherein the entire cooking vessel rotates during the cooking process within the microwave oven.

8. The cooking vessel of claim 1 further comprising a cover dimensioned to cover each of the plate members.

9. A multi-level stackable cooking vessel for a microwave oven, the cooking vessel comprising:

a plurality of plate members dimensioned to fit inside a cooking cavity of the microwave oven;

each plate member having a bowl frame having an opened top edge with a collar circumferentially surrounding the opened top edge and integrally attached thereto;

a plurality of slits positioned within the bowl frame;

each slit extending from the center of the bowl to the top edge of the bowl and is permanently affixed thereto;

a plurality of integrated leg support members strategically positioned underneath the collar of the plate member, each leg member projecting linearly downward therefrom to short predetermined distance defining a lower end; and a plurality of recesses strategically situated on a top side of the collar of each plate member, the plurality of recesses corresponding to the plurality of leg support members, each recess adapted to operatively and releasably engage with the lower end of a corresponding leg member attached to a second plate member located thereabove wherein a multi-level stackable arrangement is formed.

10. The cooking vessel of claim 9 wherein the bowl frame has a circular configuration.

11. The cooking vessel of claim 9 wherein each plate member is supported by at least three integrated leg members.

12. The cooking vessel of claim 9 further comprising:

a heating element member sandwiched between the topside and an under side of the collar of each plate member; and the heating element member completely encompassed within the collar of each plate member.

13. The cooking vessel of claim 9 further comprising:

a turntable with a built-in spinning mechanism; and the turntable adapted to operatively and releasably engage underneath the center portion of the plate member wherein the entire cooking vessel rotates during the cooking process within the microwave oven.

14. The cooking vessel of claim 1 further comprising a cover dimensioned to cover the plurality of the plate members.

* * * * *